US009286827B2

(12) United States Patent
Lee

(10) Patent No.: US 9,286,827 B2
(45) Date of Patent: Mar. 15, 2016

(54) ORGANIC LIGHT EMITTING DISPLAY APPARATUS AND METHOD OF OPERATING THE SAME

(71) Applicant: SAMSUNG DISPLAY CO., LTD., Yongin, Gyeonggi-Do (KR)

(72) Inventor: Hyun-Jae Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 153 days.

(21) Appl. No.: 13/945,807

(22) Filed: Jul. 18, 2013

(65) Prior Publication Data

US 2014/0184578 A1 Jul. 3, 2014

(30) Foreign Application Priority Data

Apr. 1, 2013 (KR) ..... 10-2013-0035461

(51) Int. Cl.
*G09G 3/32* (2006.01)

(52) U.S. Cl.
CPC ..... *G09G 3/3225* (2013.01); *G09G 2330/026* (2013.01)

(58) Field of Classification Search
USPC ..... 345/82, 211
See application file for complete search history.

(56) References Cited

U.S. PATENT DOCUMENTS

| | | | | |
|---|---|---|---|---|
| 7,592,981 | B2 | 9/2009 | Maeda | |
| 2007/0080905 | A1 | 4/2007 | Takahara | |
| 2009/0167750 | A1 | 7/2009 | Hong et al. | |
| 2010/0220090 | A1 * | 9/2010 | Plut | 345/211 |
| 2011/0025667 | A1 * | 2/2011 | Chung | 345/211 |
| 2011/0175880 | A1 * | 7/2011 | Lee | 345/211 |
| 2012/0127150 | A1 * | 5/2012 | Kim et al. | 345/212 |

FOREIGN PATENT DOCUMENTS

| | | | |
|---|---|---|---|
| JP | 2009-110008 | A | 5/2009 |
| KR | 10-2007-0085602 | A | 8/2007 |
| KR | 10-2009-0073473 | A | 7/2009 |

* cited by examiner

*Primary Examiner* — Kumar Patel
*Assistant Examiner* — Amy C Onyekaba
(74) *Attorney, Agent, or Firm* — Lewis Roca Rothgerber Christie LLP

(57) ABSTRACT

An organic light emitting display (OLED) apparatus including a power driver for applying a driving voltage to a display panel, a driver driving unit for applying a driving signal to the power driver, and a processor for applying a display data signal, which corresponds to a value of data displayed on the display panel, to the power driver. The power driver is configured to apply the driving voltage to the display panel when the driving signal and display data signal are each in an active state.

18 Claims, 4 Drawing Sheets

ORGANIC LIGHT EMITTING DISPLAY APPARATUS AND METHOD OF OPERATING THE SAME

CROSS-REFERENCE TO RELATED APPLICATION

This application claims priority to and the benefit of Korean Patent Application No. 10-2013-0035461, filed on Apr. 1, 2013, in the Korean Intellectual Property Office, the disclosure of which is incorporated herein in its entirety by reference.

BACKGROUND

1. Field

Embodiments of the present invention relate to an organic light emitting display (OLED) apparatus and a method of operating the same.

2. Description of the Related Art

An organic light emitting display (OLED) apparatus may be lightweight and thin, and may provide a wide viewing angle, fast response speed, and low power consumption. Thus, OLED apparatuses are in the spotlight as next-generation display apparatus.

To operate a flat panel display device including the OLED apparatus, various voltages may be used. For example, a portable device including the OLED apparatus may use a first power voltage ELVDD and a second power voltage ELVSS to operate pixel circuits provided in a display panel.

However, if timing is different between applying data, which includes information to display on the display panel, and supplying power voltage, then, unintended images may be displayed on the display panel.

SUMMARY

Embodiments of the present invention provide an organic light emitting display (OLED) apparatus and method of operating the same to prevent images from being distorted or garbage data from being displayed due to the different timing between actually applying data and supplying power voltage.

According to an embodiment of the present invention, there is provided an organic light emitting display apparatus including: a power driver configured to supply a driving voltage to a display panel; a driver driving unit configured to apply a driving signal to the power driver; and a processor configured to apply a display data signal to the power driver, the display data signal corresponding to a value of data to be displayed on the display panel. Here, the power driver is configured to supply the driving voltage to the display panel when the driving signal and the display data signal are both in an active state.

The power driver may be a DC-to-DC converter for generating the driving voltage to drive the display panel using power supplied from a battery.

The organic light emitting display apparatus may further include a logic gate configured to receive the driving signal and the display data signal and to output an active signal to the power driver.

The power driver may be configured to supply the driving voltage to the display panel when the active signal is received from the logic gate; and the logic gate may be configured to apply the active signal to the power driver when the driving signal and display data signal are both in the active state.

The processor may be configured to generate a driver control signal including display data to display on the display panel, and to apply the driver control signal to the driver driving unit.

The display data signal may include a dummy frame before an actual display data signal, the actual display data signal being for display on the display panel when the display panel is in the active state.

The dummy frame may be maintained for about 0.3 seconds to about 2.0 seconds.

According to one embodiment, during the dummy frame, the processor is configured to generate a driver control signal to output a black screen on the display panel, and to apply the driver control signal to the driver driving unit to output the black screen on the display panel.

According to an aspect of the present invention, there is provided a method of operating an organic light emitting display apparatus including a power driver for a display panel, the method including: using a processor to generate a display data signal corresponding to a value of data to be displayed on the display panel, and to apply the display data signal to the power driver; using a driver driving unit to apply a driving signal to the power driver; and using the power driver to generate a driving voltage for the display panel according to the driving signal and the display data signal.

The power driver may generate the driving voltage for the display panel when the driving signal and the display data signal are both in an active state.

The power driver may be a DC-to-DC converter for generating the driving voltage to drive the display panel using power supplied from a battery.

The processor may apply the display data signal to a first input terminal of a logic gate, the driver driving unit may apply the driving signal to a second input terminal of the logic gate, and the logic gate may apply an active signal to the power driver when the driving signal and display data signal are both in an active state.

The processor may generate a driver control signal including display data to display on the display panel, and may apply the driver control signal to the driver driving unit.

The display data signal may include a dummy frame before an actual display data signal, the actual display data signal being for display on the display panel when the display panel is in an active state.

The dummy frame may be maintained for about 0.3 seconds to about 2.0 seconds.

According to one embodiment, during the dummy frame, the processor generates a driver control signal to output a black screen on the display panel, and applies the driver control signal to the driver driving unit.

According to an aspect of the present invention, there is provided a method of operating an organic light emitting display apparatus including a power driver for a display panel, the method including: using a processor to generate a driver control signal including display data to display on the display panel, and to apply the driver control signal to a driver driving unit; using the driver driving unit to apply a driving signal to the power driver; and using the power driver to receive the control signal and to generate a driving voltage for the display panel. Here, the driver control signal includes a dummy frame that is in a period before the display data is in an active state.

The dummy frame may be maintained for about 0.3 seconds to about 2.0 seconds.

According to one embodiment, during the dummy frame, the processor generates the driver control signal to output a black screen on the display panel, and applies the driver control signal to the driver driving unit.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Figure 1:
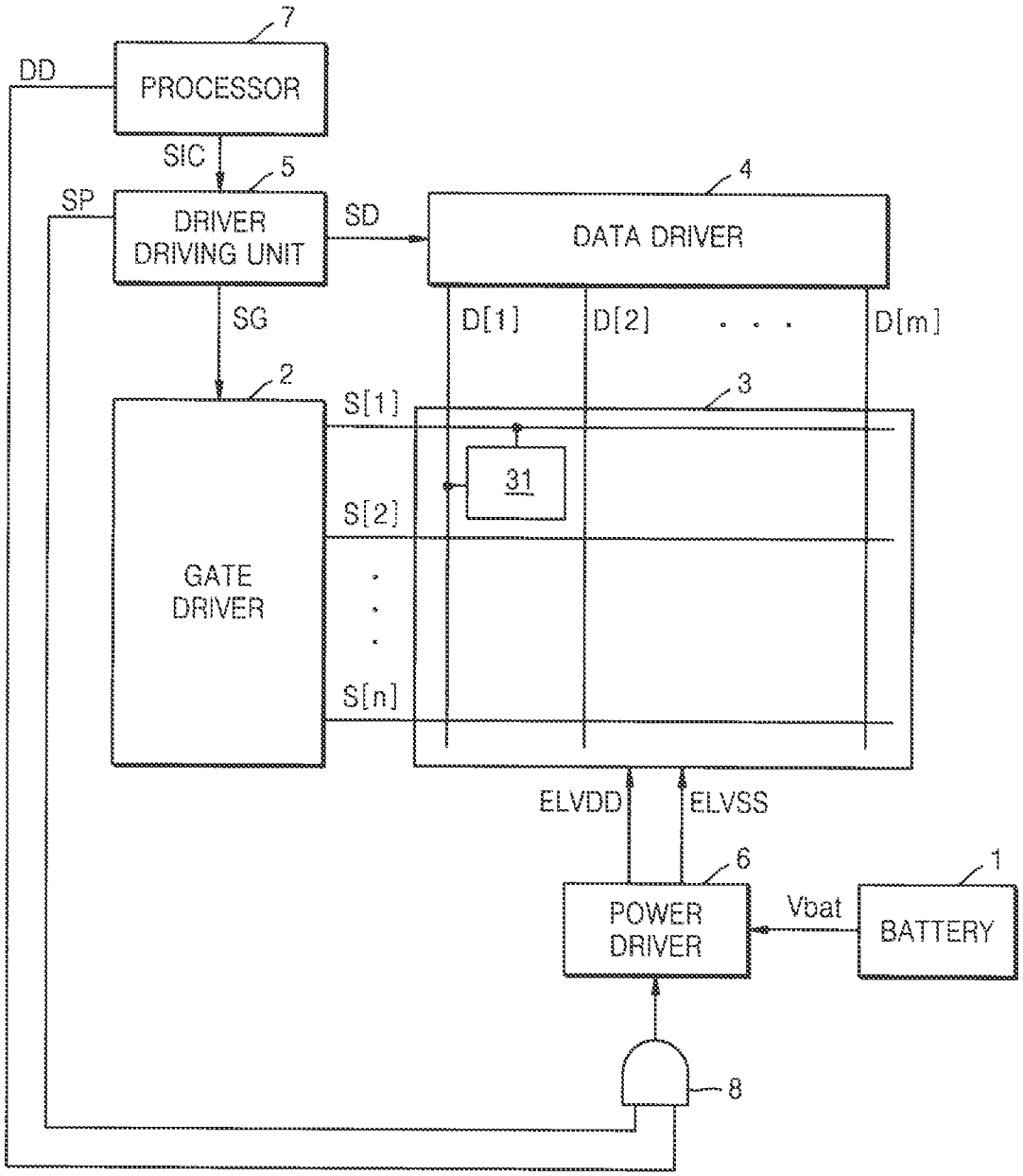
FIG. 1 is a schematic diagram of an organic light emitting display (OLED) apparatus and a surrounding structure thereof according to an embodiment of the present invention.

The invention will be described more fully hereinafter with reference to the accompanying drawings, in which illustrative embodiments of the invention are shown. Each illustrative embodiment of the present invention may be different, but may not necessarily be mutually exclusive. For example, certain forms, structures and features described in this disclosure may be modified and adapted without departing from the spirit and scope of the present invention. Also, positions and arrangements of individual components may be modified without departing from the spirit and scope of the present invention. Therefore, this invention may be embodied in many different forms and should not be construed as limited to the embodiments set forth herein. Rather, these embodiments are provided so that this disclosure will be thorough and complete, and will fully convey the scope of the invention to those skilled in the art. Like reference numerals in the drawings denote like elements.

FIG. 1 is a schematic diagram of an organic light emitting display (OLED) apparatus and a surrounding structure thereof according to an embodiment of the present invention. Referring to FIG. 1, the OLED apparatus according to the present embodiment may include a gate driver 2, a display panel 3, a data driver 4, a driver driving unit 5, and a power driver 6. Embodiments of the present invention may also include a processor 7, which inputs data to be displayed on the OLED apparatus, and a battery 1 supplying power to the OLED apparatus.

The battery 1, according to the present embodiment, supplies power to the power driver 6. The battery 1 may be a rechargeable secondary battery, such as a lead-acid storage battery, a nickel-cadmium (NiCd) battery, a lithium-ion (Li-ion) battery, a nickel-metal hydride (NiMH) battery, or a Li-ion polymer battery. However, the battery 1 may not be limited thereto, and may be a primary battery. Although not illustrated, the battery 1 according to the present embodiment may supply power not only to the power driver 6, but also to the driver driving unit 5, and other components of the present invention which use power.

The gate driver 2 generates a scan signal, and sequentially supplies the generated scan signal to scan lines connected to the gate driver 2. The gate driver 2 may include a shift register to sequentially supply the scan signal to the scan lines.

In detail, the gate driver 2 supplies the scan signal to the scan lines S[1]-S[n] according to a gate control signal SG from the driver driving unit 5. The scan signal is sequentially applied to the scan lines S[1]-S[n], and a data signal is applied to a pixel circuit 31 according to the applied scan signal.

The data driver 4 applies the data signal to data lines D[1]-D[m] according to a data control signal SD received from the driver driving unit 5. The data lines D[1]-D[m] are respectively connected to output terminals of the data driver 4.

The display panel 3 receives the scan signal from the gate driver 2. Also, a first power voltage ELVDD and a second power voltage ELVSS are supplied to each pixel circuit 31 provided in the display panel 3.

Furthermore, the display panel 3 includes n×m number of pixel circuits 31, n number of horizontal scan lines S[1]-S[n], and m number of vertical data lines D[1]-D[m]. The scan lines S[1]-S[n]transfer the scan signals to pixel circuits 31.

Also, the data lines D[1]-D[m]transfer the data signals to pixel circuits 31. The display panel 3 may be an OLED panel, but is not limited thereto.

To drive the display panel 3, the driver driving unit 5 may apply the gate control signal SG for the gate driver 2, the data control signal SD for the data driver 4, and a power control signal SP for the power driver 6, respectively to the gate, data, and power drivers 2, 4 and 6.

Although in FIG. 1 the gate driver 2, the data driver 4, and the driver driving unit 5 are illustrated separately, embodiments of the present invention are not limited thereto, for example, the components described above may be included in (or mounted on) a single driver integrated circuit (IC).

According to an embodiment, the processor 7 generates user data and control signals to provide a display on the display panel, and applies a driver driving signal SIC to the driver driving unit 5, and applies a display data signal DD to the power driver 6. The processor 7 may convert the data signal of the content, which is desired to be displayed on a device using the OLED apparatus according to the present embodiment, into a signal that correspond to a signal for the display apparatus, and thus, may provide the converted result to the driver driving unit 5. Also, according to an embodiment of the present invention, the processor 7 may apply the display data signal DD to a logic gate 8 and may control the operation of the power driver 6.

The power driver 6 may receive the power control signal SP from the driver driving unit 5 via the logic gate 8, and may generate voltages used to operate the pixel circuits 31. For example, the power driver 6 may be provided separately in the external area of the driver IC, and may supply the first and second power voltages ELVDD and ELVSS to the display panel 3. Although not illustrated in FIG. 1, the power driver 6 may supply voltages used to operate the gate driver 2, and may also supply a gamma voltage to the data driver 4.

The power driver 6 may be a DC-to-DC converter. The power driver 6 may receive a voltage (e.g., a predetermined voltage) Vbat from the power source, e.g., the battery 1, and convert the received voltage Vbat to the first and second power voltages ELVDD and ELVSS, which are used at display panel 3, and supply the voltages ELVDD and ELVSS to the display panel 3.

According to the present embodiment, when the display panel 3 is operated by a user, for example, when the user presses a button on a cellular phone to display an image on a display panel, the power driver 6 generates voltages used to operate the display panel 3.

According to the present embodiment, the power control signal SP received from the driver driving unit 5 and the display data signal DD received from the processor 7 are applied to the power driver 6 through the logic gate 8.

The logic gate 8 according to the present embodiment receives the power control signal SP from the driver driving unit 5 and receives the display data signal DD from the processor 7, and executes a logic operation. When (e.g., only when) the two signals SP and DD are in an active state, the logic gate 8 applies an active signal to the power driver 6. In the embodiment of FIG. 1, the logic gate 8 may be an AND gate. Here, the logic gate 8 applies a signal in a "HIGH" logic state to the power driver 6 when (e.g., only when) the two signals SP and DD are both in a "HIGH" logic state. However, the logic gate 8 is not only limited to the "AND" gate, and may be any logic circuit of which the output is activated when all of the inputs are in an active state. Moreover, according to the embodiment of FIG. 1, even though the logic gate 8 is illustrated as if the logic gate 8 is provided separately in an external area, according to another embodiment of the present invention, the logic gate 8 may be a logic circuit of the processor 7, the driver driving unit 5, or the power driver 6.

In a conventional OLED apparatus, the power control signal may be directly applied from the driver driving unit to the power driver, and the processor may apply the driver driving signal only to the driver driving unit. Therefore, due to a different timing between the operation of the display panel and actual application of the data, a fuzzy screen or unintentional garbage data may appear on the display apparatus.

For example, some devices that use OLED apparatuses automatically set in a sleep mode to prevent a display panel from being "ON" for a long time, and thus, reduce consuming residual battery capacity. In the sleep mode, the display panel maintains an "OFF" state, that is, a black screen. However, if a user operates predetermined buttons and changes the status of the device from the sleep mode to an idle mode, a power driver supplies driving voltages to operate the display panel, and a processor transfers the driver driving signal, which includes information regarding data to be displayed, to a driver driving unit.

In a conventional OLED apparatus, the driver driving unit generates the gate control signal for the gate driver and the data control signal for the data driver according to the driver driving signal of the processor. Also, in the conventional OLED apparatus, the driver driving unit separately applies the power control signal to the power driver. According to the supplied power control signal, the power driver generates the first and second voltages, and supplies the generated voltages to the display panel.

Therefore, in the conventional OLED apparatus, the processor applies the driver driving signal only to the driver driving unit, and does not additionally apply a separate signal to the power driver. Thus, the timing is different between actually applying the display data on the display panel and supplying the driving voltages to the power driver. Thus, a fuzzy screen or unintentional garbage data may appear on the display panel.

Figure 2A:
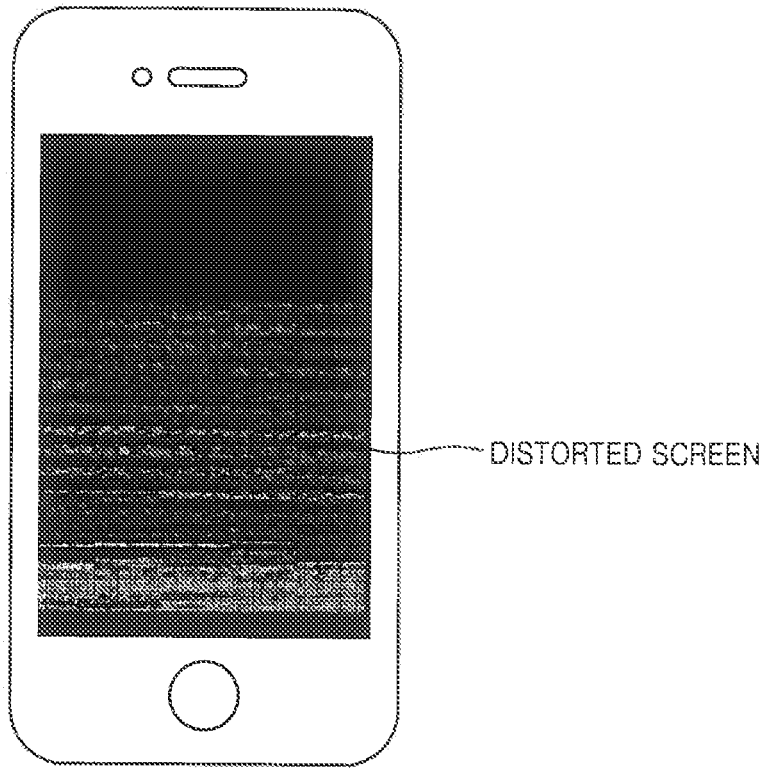
FIGS. 2A and 2B are exemplary views of a case where a fuzzy screen or a gray screen appears on a conventional OLED apparatus.
Figure 2B:
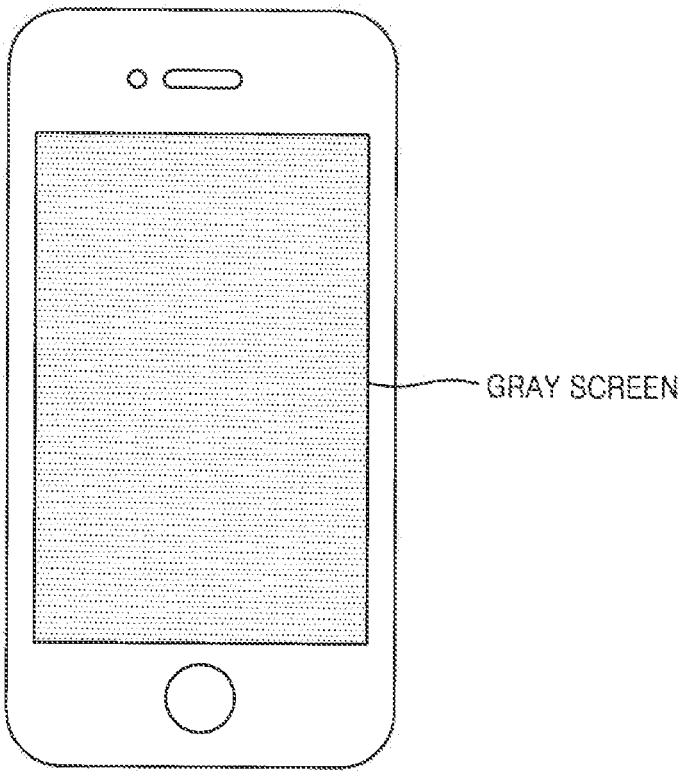

FIGS. 2A and 2B are exemplary views of a case where a fuzzy screen or a gray screen, respectively, appears on a conventional OLED apparatus. In the conventional OLED apparatus, even if driving voltages are supplied to the display panel, when appropriate signals are not applied to the scan lines and data lines, garbage data, such as a fuzzy or gray screen as in FIGS. 2A and 2B, respectively, may be displayed.

To address the phenomenon described above, the processor 7, according to an embodiment of the present invention, generates the display data signals DD, and applies the generated signals DD to the power driver 6 via the logic gate 8, to thus, supply power to the display panel 3 is consideration of the time when actual data is being reflected. The display data signals DD reflect (or correspond to) data values that are shown to the actual user through the display panel 3.

Hereinafter, methods of operating the OLED apparatus according to embodiments of the present invention will be described by referring to the timing diagrams of FIGS. 3 and 4.

Figure 3:
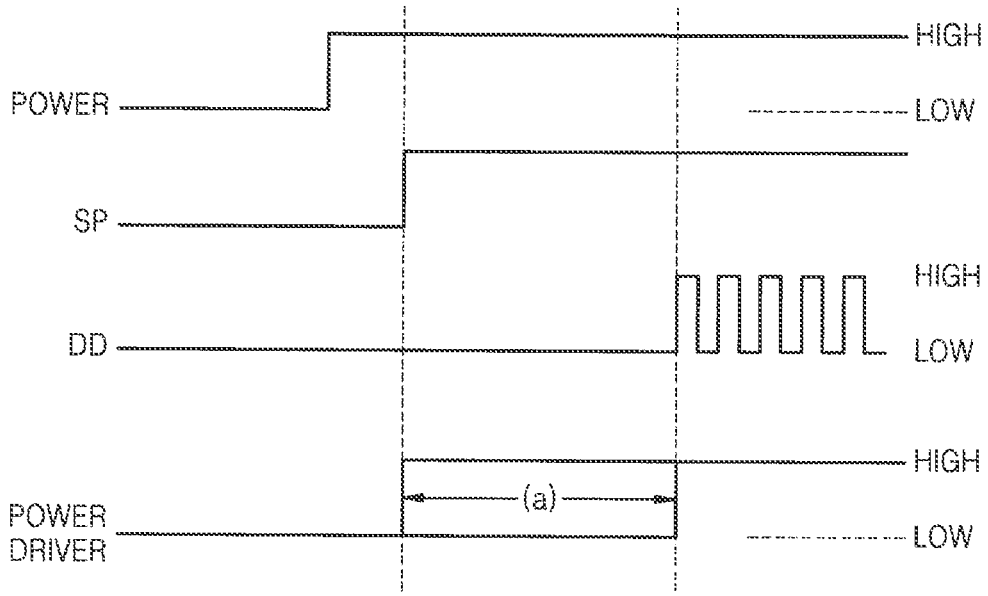
FIG. 3 is a timing diagram illustrating timing of respective signals of an OLED apparatus along a temporal axis, according to an embodiment of the present invention.

FIG. 3 is a timing diagram illustrating timing of the each signal of the OLED apparatus along a temporal axis, according to an embodiment of the present invention. The following description will be provided assuming that in the description of FIG. 3 the battery status POWER is in a "HIGH" logic state.

When a device changes from a sleep mode to an idle mode, for example, due to a user operating a button or to an internal alarm in the device, the processor 7 sends the driver driving signal SIC to the driver driving unit 5. Thus, the power control signal SP for the power driver 6 is converted to a "HIGH" logic state. In this case, the display panel 3 may be reset.

Also, the processor 7 converts user commands electrically and generates the display data signals DD, and sends the generated display data signals DD to the power driver 6.

In the conventional OLED apparatus, the power driver that received the power control signal is immediately converted to a "HIGH" logic state. Therefore, there may exist a period in which the power control signal for the power driver is converted to a "HIGH" logic state (and the power driving unit is converted to a "HIGH" logic state) but the actual data is not yet reflected on the display panel. That is, a converting period "a" exists. Thus, because the display panel is turned on, but the actual data is not yet received, a fuzzy or gray screen may be displayed due to a buffer in the driver driving unit or garbage data remaining in the memory during the converting period "a."

However, according to an embodiment of the present invention, the display data signal DD, which reflects (or corresponds to) actual data displayed in the processor 7, is applied to the driver driving unit 5 through the logic gate 8. Therefore, when the power control signal SP received from the driver driving unit 5 and the display data single DD received from the processor 7 are both applied in a "HIGH" logic state, the power driver 6 is converted into a "HIGH" logic state to thereby display appropriate data on the display panel 3.

By using the operating method described above, because the power driver 6 in the OLED apparatus according to the present embodiment is operated after (e.g., only after) the actual display data signal DD is applied, fuzzy or gray screens may not appear during the converting period "a." Also, because the time when the power driver 6 is turned on depends on the display data signal DD of the processor 7, the operating timing of the display panel 3 may be adjusted more precisely than that of a conventional OLED apparatus.

Figure 4:
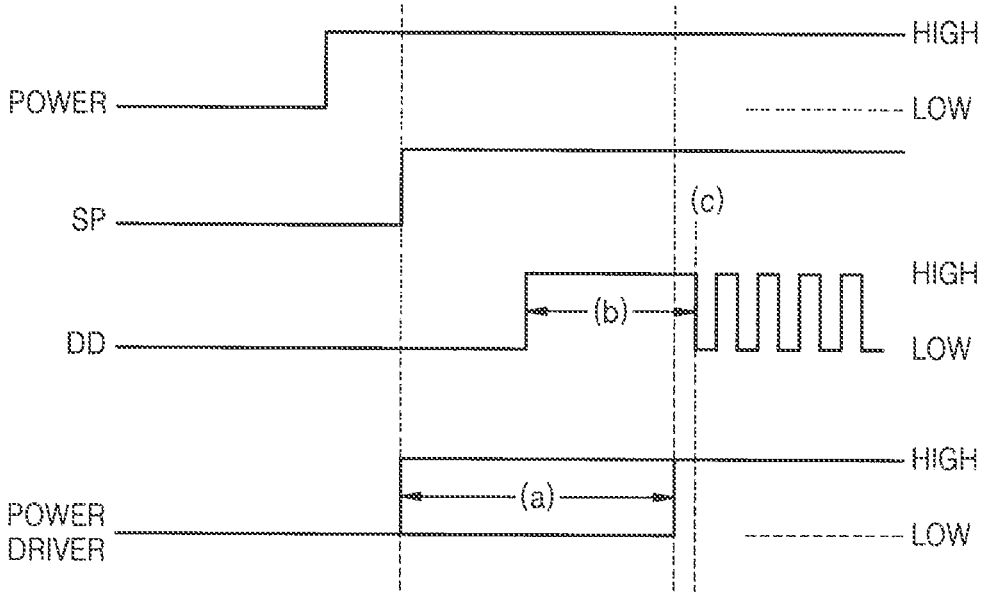
FIG. 4 is a timing diagram illustrating timing of respective signals of an OLED apparatus along a temporal axis, according to another embodiment of the present invention.

FIG. 4 is a timing diagram according to another embodiment of the present invention. As in FIG. 3, assuming that a case where the battery status POWER is in a "HIGH" logic state, the FIG. 4 embodiment will be described in detail.

When a device changes from a sleep mode to an idle mode, for example, due to operation of a button or an internal alarm in the device, the processor 7 sends the driver driving signal SIC to the driver driving unit 5. Thus, the power control signal SP for the power driver 6 is converted to a "HIGH" logic state. In this case, the display panel 3 may be reset.

The processor 7 may convert user commands electrically, may generate the display data signal DD, and may send the generated display data signal DD to the power driver 6.

Here, according to another embodiment of the present invention, before a time "c" when the user display data is actually reflected, a dummy frame is inserted in a period "b" of the display data signal DD.

During the period "b," where the dummy frame is inserted, the processor 7 may generate the driver driving signal SIC to display a black screen on the display panel 3. That is, the driver driving signal SIC may also include the dummy frame that is inserted before the data (which is to be displayed on the display panel 3) is active. The dummy frame may be set to display the black screen.

As described above, when the dummy frame is inserted, there is a converting period "a" that is overlapped with the dummy frame period "b," which is at a time when the driver driving unit 5 is converted into a "HIGH" logic state but the actual user data is not yet reflected on the display panel 3. For example, during the converting period "a" that is overlapped with the dummy frame section "b", instead of a fuzzy or gray screen, a black screen is displayed. The dummy frame period "b" may be from about 0.3 seconds to about 2.0 seconds.

Using the logic gate 8 of FIG. 1, during the converting period "a" that is not overlapped with the dummy frame period "b," the display panel 3 is not turned on. During the converting period "a" that is overlapped with the dummy frame period "b," the dummy frame set to display a black screen is displayed. Therefore, because even before the time "c" when actual data is displayed, the user recognizes the dummy frame period "b" as the device in a sleep mode, thus, visual problems, such as a fuzzy screen, may not occur.

The present invention has been particularly shown and described with reference to exemplary embodiments thereof. For the conciseness of the specification, conventional electronic components, control systems, software, and other functional features of the systems described above may have been omitted. Also, lines or members connecting components illustrated in the drawings are exemplary illustrations of functional connections and/or physical or circuital connections. In actual applications of the present invention, other various functional, physical or circuital connections may be substituted or supplemented thereto. In addition, some elements may have been included for assisting in understanding aspects of an embodiment of the present invention, and as such, may not be included in every embodiment of the present invention.

The use of the terms "a" and "an" and "the" and similar referents in the context of describing embodiments of the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context. The present invention is not limited to the described order of the steps. The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those skilled in this art without departing from the spirit and scope of the present invention.

While the present invention has been particularly shown and described with reference to exemplary embodiments thereof, it will be understood by those of ordinary skill in the art that various changes in form and details may be made therein without claims and their equivalents.

What is claimed is:

1. An organic light emitting display apparatus comprising:

a power driver configured to supply a driving voltage to a display panel;

a driver driving unit configured to apply a driving signal to the power driver; and a processor configured to apply a display data signal to the power driver, the display data signal corresponding to a value of data to be displayed on the display panel, wherein the power driver is configured to supply the driving voltage to the display panel when the driving signal and the display data signal are both in an active state.

2. The organic light emitting display apparatus according to claim 1, wherein the power driver is a DC-to-DC converter for generating the driving voltage to drive the display panel using power supplied from a battery.

3. The organic light emitting display apparatus according to claim 1 further comprising a logic gate configured to receive the driving signal and the display data signal and to output an active signal to the power driver.

4. The organic light emitting display apparatus according to claim 3, wherein the power driver is configured to supply the driving voltage to the display panel when the active signal is received from the logic gate; and wherein the logic gate is configured to apply the active signal to the power driver when the driving signal and display data signal are both in the active state.

5. The organic light emitting display apparatus according to claim 1, wherein the processor is configured to generate a driver control signal comprising display data to display on the display panel, and to apply the driver control signal to the driver driving unit.

6. The organic light emitting display apparatus according to claim 1, wherein the display data signal comprises a dummy frame before an actual display data signal, the actual display data signal being for display on the display panel when the display panel is in the active state.

7. The organic light emitting display apparatus according to claim 6, wherein the dummy frame is maintained in a range from 0.3 seconds to 2.0 seconds.

8. The organic light emitting display apparatus according to claim 6, wherein during the dummy frame, the processor is configured to generate a driver control signal to output a black screen on the display panel, and to apply the driver control signal to the driver driving unit to output the black screen on the display panel.

9. A method of operating an organic light emitting display apparatus comprising a power driver for a display panel, the method comprising:

using a processor to generate a display data signal corresponding to a value of data to be displayed on the display panel, and to apply the display data signal to the power driver;

using a driver driving unit to apply a driving signal to the power driver; and using the power driver to generate a driving voltage for the display panel according to the driving signal and the display data signal, wherein the power driver generates the driving voltage for the display panel when the driving signal and the display data signal are both in an active state.

10. The method of claim 9, wherein the power driver is a DC-to-DC converter for generating the driving voltage to drive the display panel using power supplied from a battery.

11. The method of claim 9, wherein the processor applies the display data signal to a first input terminal of a logic gate, wherein the driver driving unit applies the driving signal to a second input terminal of the logic gate, and wherein the logic gate applies an active signal to the power driver when the driving signal and display data signal are both in an active state.

12. The method of claim 9, wherein the processor generates a driver control signal comprising display data to display on the display panel, and applies the driver control signal to the driver driving unit.

13. The method of claim 9, wherein the display data signal comprises a dummy frame before an actual display data signal, the actual display data signal being for display on the display panel when the display panel is in an active state.

14. The method of claim 13, wherein the dummy frame is maintained in a range from 0.3 seconds to 2.0 seconds.

15. The method of claim 13, wherein during the dummy frame, the processor generates a driver control signal to output a black screen on the display panel, and applies the driver control signal to the driver driving unit.

16. A method of operating an organic light emitting display apparatus comprising a power driver for a display panel, the method comprising:

using a processor to generate a driver control signal comprising display data to display on the display panel, and to apply the driver control signal to a driver driving unit;

using the driver driving unit to apply a driving signal to the power driver according to the driver control signal; and using the power driver to receive the driving signal and to generate a driving voltage for the display panel, wherein the driver control signal comprises a dummy frame that is in a converting period after the driving signal is applied to the power driver and before the display data is in an active state.

17. The method of claim 16, wherein the dummy frame is maintained in a range from 0.3 seconds to 2.0 seconds.

18. The method of claim 16, wherein during the dummy frame, the processor generates the driver control signal to output a black screen on the display panel, and applies the driver control signal to the driver driving unit.

* * * * *